US007178538B2

(12) United States Patent
Ransom

(10) Patent No.: US 7,178,538 B2
(45) Date of Patent: Feb. 20, 2007

(54) PORTABLE, SELECTIVELY-REVERSIBLE ENCLOSURE

(76) Inventor: Robert M. Ransom, 8102 Coldwater Rd., Flushing, MI (US) 48433

( * ) Notice: Subject to any disclaimer, the term of this patent is extended or adjusted under 35 U.S.C. 154(b) by 0 days.

(21) Appl. No.: 11/358,667

(22) Filed: Feb. 21, 2006

(65) Prior Publication Data

US 2006/0138911 A1 Jun. 29, 2006

Related U.S. Application Data

(63) Continuation of application No. 10/987,494, filed on Nov. 12, 2004, now abandoned.

(51) Int. Cl.
*E04H 15/40* (2006.01)

(52) U.S. Cl. ..... 135/125; 135/901; 135/115

(58) Field of Classification Search ..... 135/124, 135/125, 126, 128, 130, 131, 152, 143, 144, 135/145, 97, 901, 900, 119, 75, 115, 116
See application file for complete search history.

(56) References Cited

U.S. PATENT DOCUMENTS

| | | | |
|---|---|---|---|
| 1,259,641 | A | 3/1918 | Livezey |
| 1,713,439 | A | 5/1929 | Klyaich |
| 1,803,626 | A | 5/1931 | Lasley |
| 2,159,273 | A | 5/1939 | Killinger |
| 2,513,764 | A | 7/1950 | Vonder Ahe |
| 2,689,579 | A | 9/1954 | Sartori |
| 2,781,766 | A | 2/1957 | Krieger |
| 2,808,846 | A | 10/1957 | Jonsson |
| 2,811,977 | A | 11/1957 | McClish |
| 2,827,729 | A | 3/1958 | Hoene |
| 2,953,145 | A | 9/1960 | Moss et al. |
| 3,052,250 | A | 9/1962 | Moss |
| 3,132,658 | A | 5/1964 | Hickman |
| 3,502,091 | A | 3/1970 | Corbin |
| 3,550,601 | A | 12/1970 | Peters |
| 3,699,986 | A | 10/1972 | Kirkham |
| 3,765,134 | A | 10/1973 | Gilchrist |
| 3,766,932 | A | 10/1973 | Sidis et al. |
| 3,799,608 | A | 3/1974 | Smutny et al. |
| 3,810,482 | A | 5/1974 | Beavers |
| 3,869,827 | A | 3/1975 | Anderson et al. |
| 3,874,397 | A | 4/1975 | Oberhaus |
| 3,880,459 | A | 4/1975 | Kelley |
| 3,929,146 | A | 12/1975 | Maiken |
| 3,941,140 | A | 3/1976 | Beavers |
| 3,960,161 | A | 6/1976 | Norman |

(Continued)

OTHER PUBLICATIONS

AMERISTEP Quality Hunting Accessories 2001 Catalog (Cover and Excerpted Pages).

*Primary Examiner*—Janet M. Wilkens
(74) *Attorney, Agent, or Firm*—Young Basile

(57) ABSTRACT

The specification describes a selectively reversible, portable enclosure comprising a collapsible framework having a flexible covering associated therewith, the flexible covering having opposite first and second surfaces each bearing a distinct color, pattern, or other indicia. Without disassociating the flexible covering from the collapsible framework, the enclosure is selectively transitionable between a first condition, wherein the first surface of the flexible covering is disposed outside of the enclosure and the second surface of the flexible covering is disposed inside of the enclosure, and a second condition, wherein the second surface of the flexible covering is disposed outside of the enclosure and the first surface of the flexible covering is disposed inside of the enclosure.

24 Claims, 7 Drawing Sheets

U.S. PATENT DOCUMENTS 3,965,915 A 6/1976 Kirkham
3,990,463 A 11/1976 Norman
4,026,312 A 5/1977 Beavers
4,067,346 A 1/1978 Husted
4,067,347 A 1/1978 Lipinski
4,068,674 A 1/1978 Mitchell
4,073,105 A 2/1978 Daugherty
4,077,417 A 3/1978 Beavers
4,106,145 A 8/1978 Gillen et al.
4,128,104 A 12/1978 Corey
4,133,149 A 1/1979 Angress
4,144,899 A 3/1979 Kays
4,154,253 A 5/1979 McCullough
4,164,089 A 8/1979 George
4,197,681 A 4/1980 Holcombe
4,224,754 A 9/1980 Derryberry
4,265,260 A 5/1981 Gillis
4,265,261 A 5/1981 Barker
4,269,210 A 5/1981 Marks
4,285,354 A 8/1981 Beavers
4,300,253 A 11/1981 Anderson
4,304,068 A 12/1981 Beder
4,323,605 A 4/1982 Rush
4,327,520 A 5/1982 Saxby et al.
4,364,193 A 12/1982 Visco
4,375,488 A 3/1983 Hogan
4,425,929 A 1/1984 Von Mosshaim
4,483,090 A 11/1984 Carper
4,607,655 A 8/1986 Wagner et al.
4,682,436 A 7/1987 Ritson
4,709,718 A 12/1987 Nichols
4,716,918 A 1/1988 Hayashida et al.
4,723,371 A 2/1988 Williams
4,738,045 A 4/1988 Cardozo
4,751,936 A 6/1988 Zibble et al.
4,794,717 A 1/1989 Horsmann
4,819,680 A 4/1989 Beavers
4,825,578 A 5/1989 Robinson
4,825,892 A 5/1989 Norman
4,941,499 A 7/1990 Pelsue et al.
4,945,936 A 8/1990 Surrendi
4,951,696 A 8/1990 Jones, Sr.
4,966,178 A 10/1990 Eichhorn
4,979,242 A 12/1990 Maggio
4,998,552 A 3/1991 Niksic et al.
5,002,083 A 3/1991 Kim
5,010,909 A 4/1991 Cleveland
5,038,812 A 8/1991 Norman
5,062,234 A 11/1991 Green
5,075,999 A 12/1991 Fredericks
5,107,881 A 4/1992 Feldman et al.
5,163,461 A 11/1992 Ivanovich et al.
5,218,982 A 6/1993 Kenji
5,222,513 A 6/1993 Hilliard
5,230,358 A 7/1993 Forell
5,241,772 A 9/1993 Hall
5,249,592 A 10/1993 Springer et al.
5,333,634 A 8/1994 Taylor
5,337,772 A 8/1994 Habchi
5,343,887 A 9/1994 Danaher
5,352,149 A 10/1994 Melashenko et al.
5,368,057 A 11/1994 Lubkeman et al.
5,377,711 A 1/1995 Mueller
5,385,165 A 1/1995 Hazinski et al.
5,394,897 A 3/1995 Ritchey et al.
5,411,046 A 5/1995 Wan
5,414,950 A 5/1995 Johnson, Sr.
5,430,980 A 7/1995 Ferrier
5,467,794 A 11/1995 Zheng
5,477,875 A 12/1995 Daly, Jr.
5,479,954 A 1/1996 Lin
5,528,849 A 6/1996 Plinta
D373,403 S 9/1996 Hall
5,613,512 A 3/1997 Bean
5,628,338 A 5/1997 Stumbo
5,630,439 A 5/1997 Hutto
5,638,850 A 6/1997 Hazinski et al.
5,647,159 A 7/1997 Latschaw
5,666,986 A 9/1997 Fox
5,669,403 A 9/1997 Belcher et al.
5,690,134 A 11/1997 McCauley
5,762,085 A 6/1998 Punch
5,813,160 A 9/1998 Thoelke
5,822,906 A 10/1998 Ward
D405,890 S 2/1999 Latschaw
5,871,026 A 2/1999 Lin
5,887,539 A 3/1999 Rex et al.
5,941,264 A 8/1999 Gregg
6,010,176 A 1/2000 Jones
6,016,823 A 1/2000 Hill
6,019,112 A 2/2000 Matlock
6,021,794 A 2/2000 Guerra
6,021,795 A 2/2000 Long et al.
6,098,335 A 8/2000 Brown, Jr.
6,164,005 A 12/2000 Copeland
6,167,898 B1 1/2001 Larga et al.
6,202,665 B1 3/2001 O'Hare
6,202,666 B1 3/2001 Rehbein
6,230,728 B1 5/2001 Reese
6,345,639 B2 2/2002 Rousselle et al.
6,357,462 B1 3/2002 Laosunthara et al.
6,390,110 B1 5/2002 Brown
6,408,865 B1 6/2002 Bliss
6,499,260 B2 12/2002 Kasinger et al.
6,502,596 B1 1/2003 Danaher
6,581,617 B2 6/2003 Ham et al.
6,618,988 B2 9/2003 Williams et al.
6,679,009 B2 1/2004 Hotes
6,701,948 B2 3/2004 Jopp et al.
6,748,963 B2 6/2004 Carter
6,782,905 B2 8/2004 Chu et al.
6,854,476 B1 2/2005 Chai
D505,175 S 5/2005 Wehner
7,040,333 B1 * 5/2006 Ransom et al. ..... 135/126
2002/0059970 A1 5/2002 Lemieux
2003/0024559 A1 2/2003 Fields

* cited by examiner

PORTABLE, SELECTIVELY-REVERSIBLE ENCLOSURE

CROSS-REFERENCE TO RELATED APPLICATIONS

This application is a continuation of, and claims the benefit of priority to, U.S. application Ser. No. 10/987,494, filed Nov. 12, 2004, now abandoned.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

FIELD OF THE INVENTION

The invention pertains to portable enclosures, including, for example, tents, hunting blinds, etc., and more particularly to such enclosures comprising a collapsible framework having a flexible, two-sided covering thereover, and wherein the entire enclosure may be selectively reversed to present one or the other side of the covering as the exterior of the enclosure.

BACKGROUND OF THE INVENTION

Easily man-portable enclosures have become a desirable accessory for many outdoor recreational activities, including, for instance, camping and hunting, and the widespread availability of modern lightweight materials and fabrics has resulted in the proliferation of numerous designs for such portable enclosures. Among the many popular current styles for such enclosures are "collapsible" structures incorporating a spring-like framework, typically made from spring steel. By reason of the resilient material of these frameworks, such enclosures are easily folded and packed for transportation and storage, and thereafter will tend spontaneously to their erected condition when unpacked. Such portable structures are exemplified in U.S. Pat. No. 3,675,667, issued to Miller.

It is also known to apply camouflage or background-matching patterns or colors to portable enclosures, as it is desirable, particularly to hunters, military personnel, and the like, that a tent or hunting blind be as inconspicuous as possible in its chosen environment. However, it has heretofore usually been necessary for such persons to acquire different enclosures for different geographic areas, different seasons, etc. The hunter, for example, who wishes to participate in both fall waterfowl hunting and winter small animal hunting might, of necessity, own two different camouflage enclosures, one depicting appropriate camouflage for the fall environment, and a second depicting appropriate camouflage for the winter environment. Likewise, hunters traveling to different geographic areas during the same season will desire different camouflage patters based on the local environment in which their activities will be conducted. A camouflage pattern suitable for July in Northern Michigan, for example, would be unsuited for use during the same season in, for instance, the Oregon high desert. Owning numerous enclosures each suited to a particular environment can become costly. Cost notwithstanding, all collapsible enclosures do have a certain volume and mass, such that it is inconvenient and cumbersome when one is obliged to transport several different enclosures at once.

The only exception to the foregoing problem known to the inventor hereof has been the inventor's own portable enclosure which provides a removable covering that may be selectively disposed over the enclosure to present a different color, pattern, or other indicia than that provided on the flexible covering of the enclosure itself.

What is needed then, is a single portable enclosure which is readily convertible between at least two patterns, colors, or other indicia without having to provide multiple components.

BRIEF SUMMARY

The specification discloses a portable enclosure comprising The specification describes a selectively reversible, portable enclosure comprising a collapsible framework having a flexible covering associated therewith, the flexible covering having opposite first and second surfaces each bearing a distinct color, pattern, or other indicia. Without disassociating the flexible covering from the collapsible framework, the enclosure is selectively transitionable between a first condition, wherein the first surface of the flexible covering is disposed outside of the enclosure and the second surface of the flexible covering is disposed inside of the enclosure, and a second condition, wherein the second surface of the flexible covering is disposed outside of the enclosure and the first surface of the flexible covering is disposed inside of the enclosure.

According to one embodiment of the present invention, the enclosure comprises a collapsible frame having a flexible covering thereover to thereby define a plurality of sidewalls and a top surface of the enclosure. The flexible covering has opposite first and second surfaces and at least one slit defined therein, the slit being positioned so as to facilitate selective arrangement of the plurality of sidewalls and top surface between a first condition, wherein the first surface of the flexible covering is disposed outside of the enclosure and the second surface of the flexible covering is disposed inside of the enclosure, and a second condition, wherein the second surface of the flexible covering is disposed outside of the enclosure and the first surface of the flexible covering is disposed inside of the enclosure.

According to one feature of the present invention, means are provided for selectively closing the slit.

According to a further feature of this invention, the slit is defined by a zipper.

Per still another feature hereof, the collapsible frame comprises a plurality of separate frame elements, each frame element defining one of the plurality of sidewalls of the enclosure.

Per yet another feature, the at least one slit is defined in the top surface of the enclosure, and between a first pair of frame elements.

According to another feature of the present invention, the flexible covering further defines a bottom of the enclosure.

Per yet another feature hereof, the at least one slit is defined in the top and bottom surfaces of the enclosure, and between a first pair of frame elements.

BRIEF DESCRIPTION OF THE DRAWINGS

These and other aspects of the present invention will be better understood with reference to the written specification and drawings, of which.

DETAILED DESCRIPTION

Figure 1:
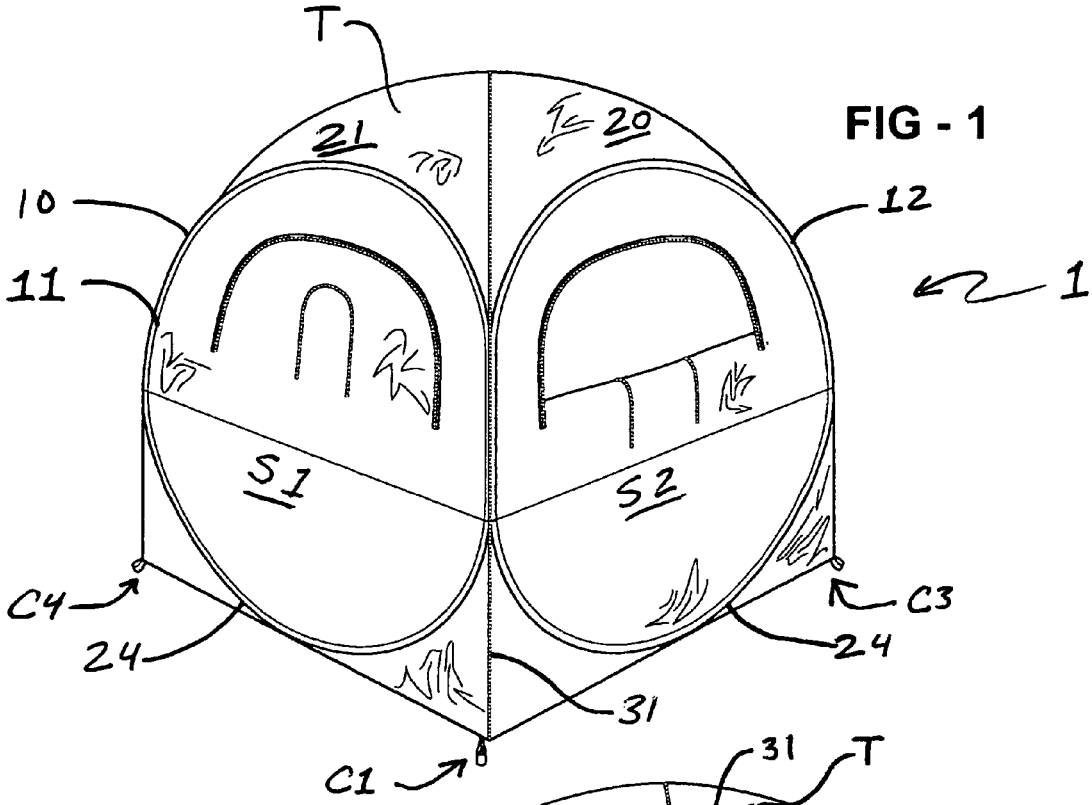
FIG. 1 is a quartering perspective showing the enclosure of the present invention.
Figure 2:
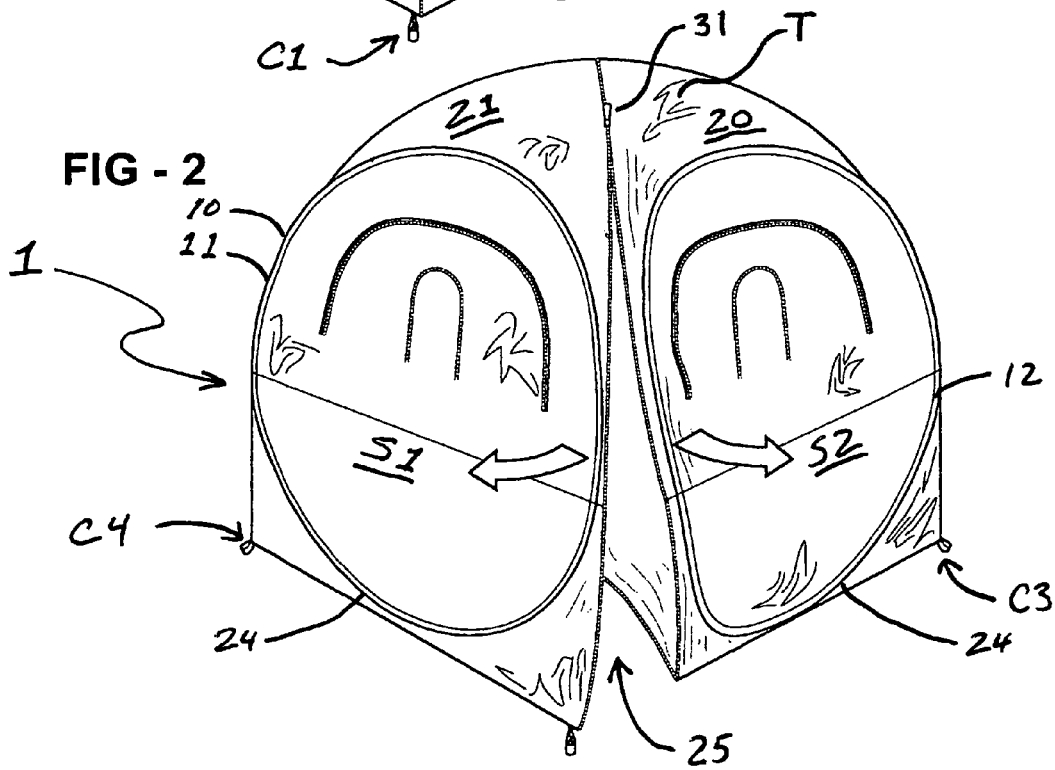
FIG. 2 is a quartering perspective of the enclosure of the present invention depicting the at least one slit in a partially opened condition.
Figure 6:
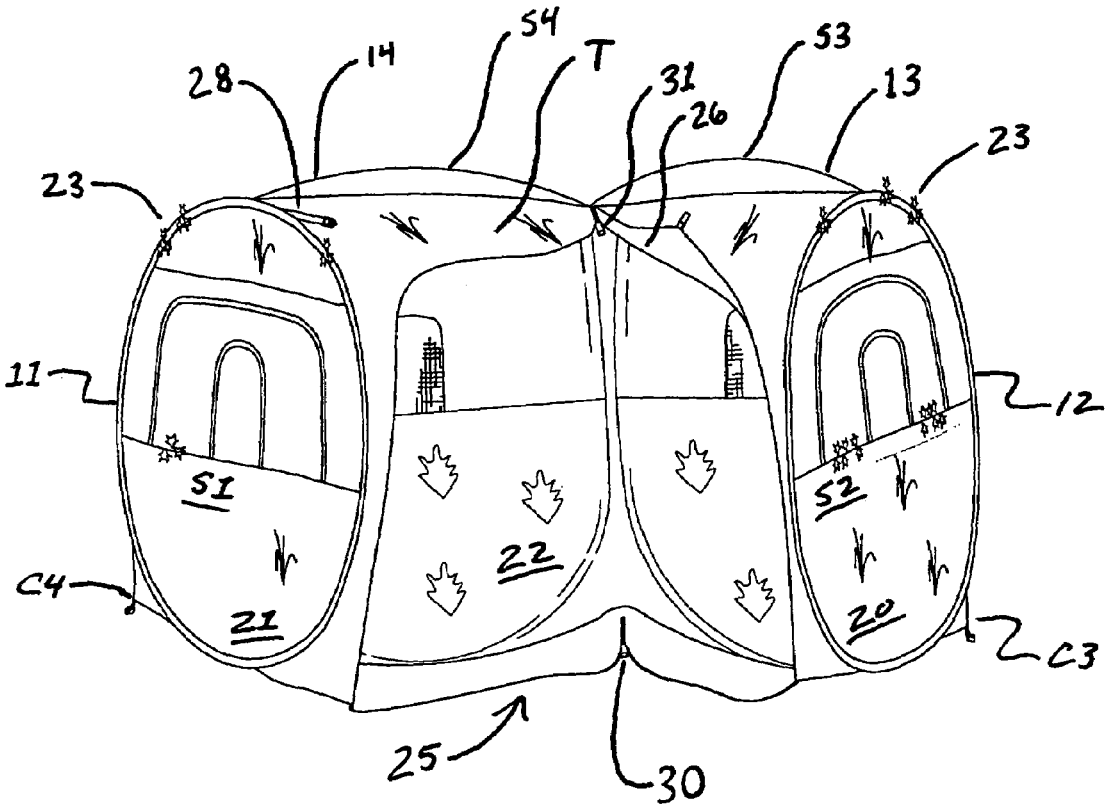
FIGS. 6–8 depict, in sequence, the operation of transitioning the inventive enclosure between the first and second conditions thereof, so as to selectively present one or the other of the opposite first and second surfaces of the flexible covering as the exterior of the enclosure.
Figure 7:
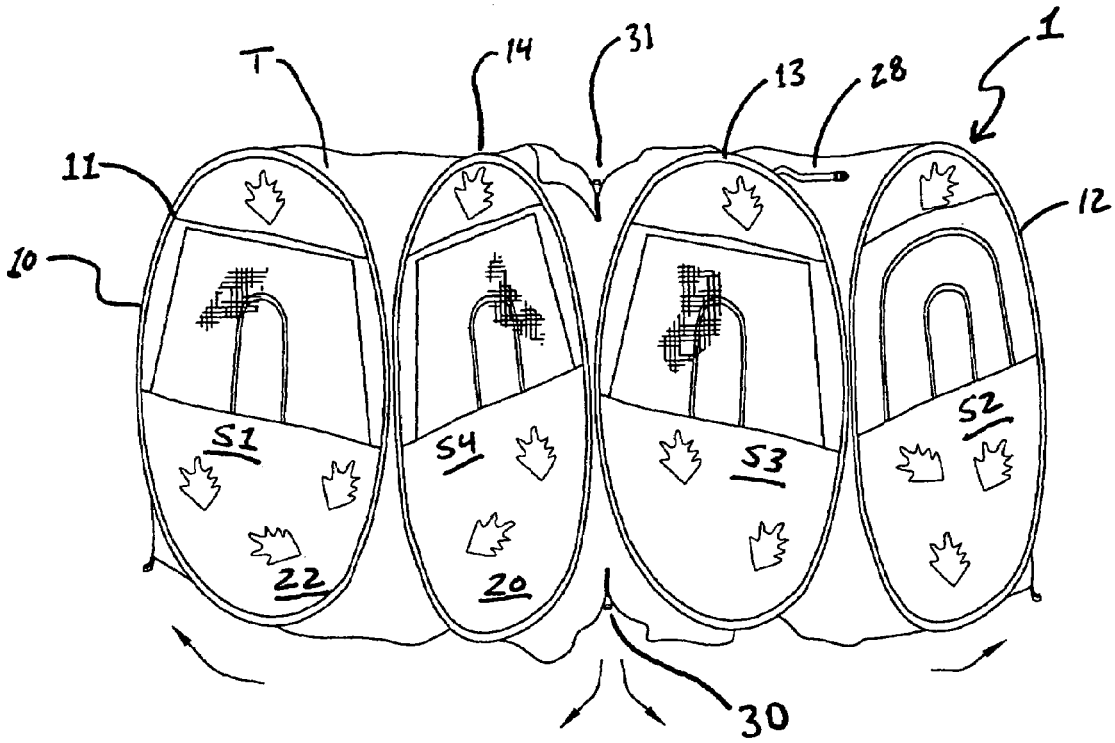

Referring now to the drawings, and FIGS. 1, 2 and 6 the present invention will be seen to most generally comprise a portable enclosure 1 including a collapsible framework 10 having a flexible covering 20 associated therewith, the flexible covering having opposite first 21 and second 22 surfaces each bearing a distinct color, pattern, or other indicia. And, as shown best in FIGS. 6 through 8, the inventive enclosure is, without disassociating the flexible covering 20 from the collapsible framework 10, selectively transitionable between a first condition (FIG. 1), wherein the first surface 21 of the flexible covering 20 is disposed outside of the enclosure 1 and the second surface (not shown) of the flexible covering is disposed inside of the enclosure, and a second condition (FIG. 8), wherein the second surface 22 of the flexible covering 20 is disposed outside of the enclosure 1 and the first surface of the flexible covering is disposed inside of the enclosure.

Figure 3:
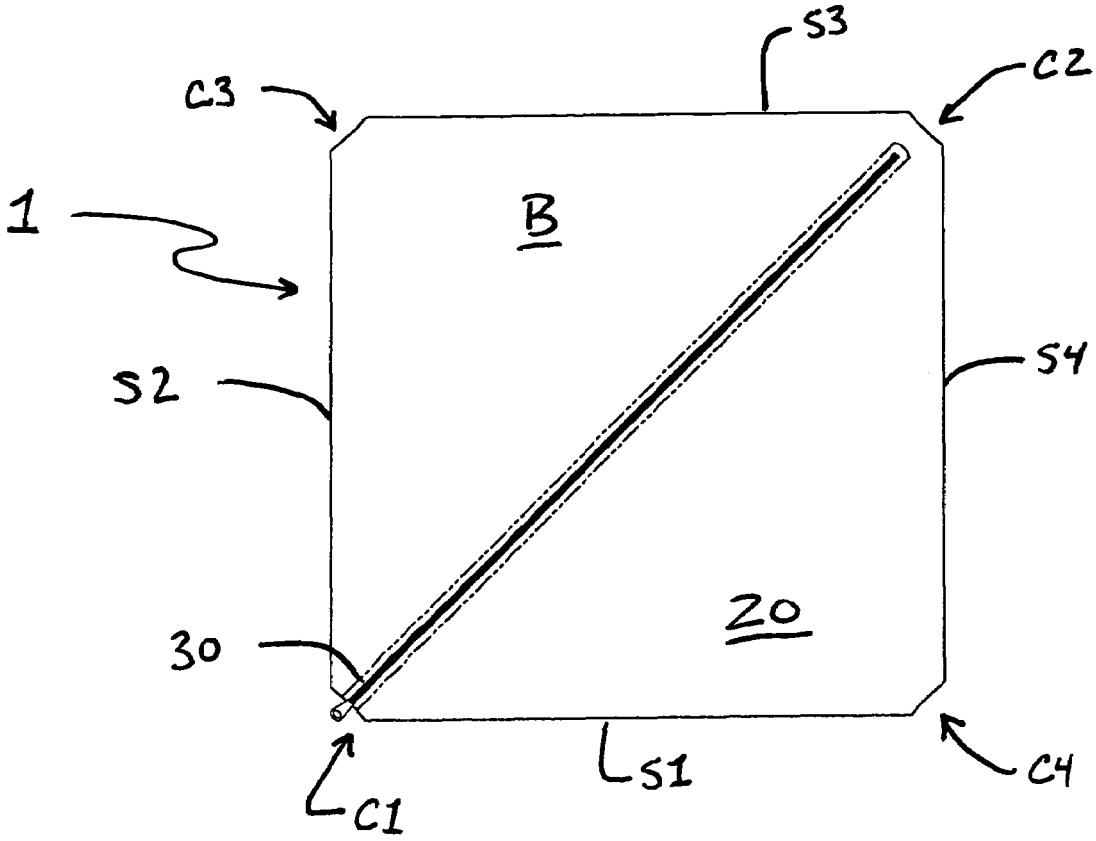
FIG. 3 is a bottom-up elevation of the enclosure of the present invention.

With continuing reference to FIGS. 1 and 2, it will be seen that, according to the illustrated embodiment, the collapsible framework 10 and flexible covering 20 define, in combination, a plurality of sidewalls S1–S4 and a top surface T of the enclosure 1. A bottom surface B, shown in FIG. 3, may also be provided as desired. While four sidewalls (S1–S4) are shown, it will be appreciated from the remainder of this disclosure that an enclosure with more or fewer sidewalls may be provided. Likewise, the overall dimensions of the enclosure, which are not part of the inventive aspect thereof, may be selected to provide for the accommodation of one or more occupants, as desired.

According to the illustrated embodiment, the framework 10 comprises a plurality of separate frame members 11, 12, 13, and 14, each defining, in combination with the flexible covering 20, one of a plurality of sidewalls S1–S4. Each such separate frame member is formed from any of a number of resilient materials, such as, for example, spring steel, fiberglass, etc., all of which are known to be both readily temporarily deformable, and all of which likewise revert spontaneously to their pre-deformed condition. Such materials thus provide the desirable collapsibility of the portable enclosure, as well as the equally desirable feature of spontaneous erection thereof.

As best shown in FIG. 6, the flexible covering 20 has, as indicated, opposite first 21 and second 22 surfaces each bearing a distinct color, pattern, or other indicia, such as, for instance, distinct camouflage features as shown. Such features may include patterns or designs applied by printing, embroidery, or other known methods, as well as three-dimensional elements, such as the illustrated fabric projections 23, to provide added realism where concealment of the enclosure in a given environment is desired. By "distinct," it is not meant that the color, pattern, or other indicia on each of the opposite first 21 and second 22 surfaces must be absolutely different.

As desired, the flexible covering 20 may further be provided with one or more ports, such as doors, shooting openings, and windows, for the convenience of the occupant or occupants.

Likewise, stake loops (not shown) or other means may be provided on the flexible covering 20 to facilitate securement of the enclosure 1 to the ground or other support surface, though such means form no part of the present invention.

While traditional fabrics such as DACRON or linen are suited for use in the flexible covering 20, numerous other synthetic and/or natural materials, all of whose suitability for enclosures is known to those skilled in the art, may also be employed in the fabrication of flexible covering 20. Moreover, the flexible covering 20 may comprise one or more pieces of such suitable materials, in one or more combinations. For instance, the flexible covering 20 may include mesh materials for windows or other openings, and water-impervious materials for the top and remainder of the sidewalls.

Though not intended to be limiting of the present invention, the association of the framework 10 with the flexible covering 20 may be best understood with reference to FIGS. 1 and 2. More particularly, each of the frame members 11, 12, 13, and 14 is disposed within passageways or sleeves 24 formed in or provided on the flexible covering 20. As desired, the sleeves 24 may be fabricated to permit selective removal of the frame members 11, 12, 13, and 14, so as to facilitate replacement of a broken frame member, for instance. Each of the frame members 11, 12, 13, and 14 serves to give shape to the flexible covering 20 and defines one of the sidewalls S1–S4 of the enclosure 1. The frame members 11, 12, 13, and 14 are positioned in the fabric covering 20 in close proximity to one another about the perimeter of the enclosure 1, with adjacent pairs of frame members defining corners C1–C4. However, the frame members 11, 12, 13, and 14 are not rigidly connected to each other at the corners C1–C4, but are instead adapted for relative movement. This may be accomplished by ensuring that each of the sleeves 24 are separate from one another.

To facilitate selective reversibility of the inventive disclosure, the operation of which is explained in further detail hereinbelow, the flexible covering 20 has, according to the illustrated embodiment, at least one selectively closeable slit 25 defined therein. The slit 25 is arranged so as to facilitate selective positioning of the plurality of sidewalls S1-S4 and top surface T between a first condition (FIG. 1), wherein the first surface 21 of the flexible covering 20 is disposed outside of the enclosure 1 and the second surface (not visible) of the flexible covering is disposed inside of the enclosure, and a second condition (FIG. 8), wherein the second surface 22 of the flexible covering 20 is disposed outside of the enclosure 1 and the first surface (not visible) of the flexible covering is disposed inside of the enclosure.

In the illustrated embodiment, the at least one slit 25 is shown to be defined by at least one zipper of conventional construction. However, other means for selectively closing the slit may also be provided, including, without limitation, hook-and-loop type fasteners, ties, buttons, etc.

In the invention as shown in FIGS. 1–4, according to which the enclosure comprises a bottom surface B as well as sidewalls S and a top surface T, slit 25 is defined by a pair of zippers 30 and 31. Zipper 30 extends from a first corner C1 of the bottom surface B defined by a pair of adjacent frames 11 and 12 to a point proximate the diagonally opposite corner C2 (FIG. 3) defined by a pair of adjacent frame members 13 and 14. Zipper 31 extends along a diagonal, lying in the same vertical plane of the diagonal of zipper 30, from a point proximate the bottom B of the enclosure and adjacent the first corner C1, along a path defined between adjacent frame members 11 and 12, and across the top surface T to a terminus proximate the corner C2 defined by adjacent frame members 13 and 14.

As will be appreciated upon reference to FIG. 6, the foregoing arrangement of zippers 30 and 31 to define slit 25 further defines a kind of living hinge of the flexible covering 20 between adjacent frame members 13 and 14 along the corner C2, the hinge connecting first and second portions of the enclosure defined on opposite sides of the slit 25.

Of course, the at least one slit 25 as described hereabove may be arranged other than as shown and, moreover, means other than the at least one slit 25 may be provided to accomplish the selective transitioning of the enclosure between the first and second conditions thereof, subject only the requirement of facilitating selective reversibility of the enclosure to present one or the other of the first or second surfaces of the flexible covering. Accordingly, it is, for instance, contemplated that the at least one slit 25 may take the form of two or more separate slits, each extending vertically along two or more corners of the enclosure defined between adjacent frame members.

In addition to the foregoing, it will also be appreciated from this disclosure that the at least one slit 25 may likewise serve to define an entrance and egress portal, as depicted in FIG. 2, where a separate egress and entrance portal is not otherwise provided.

Figure 4:
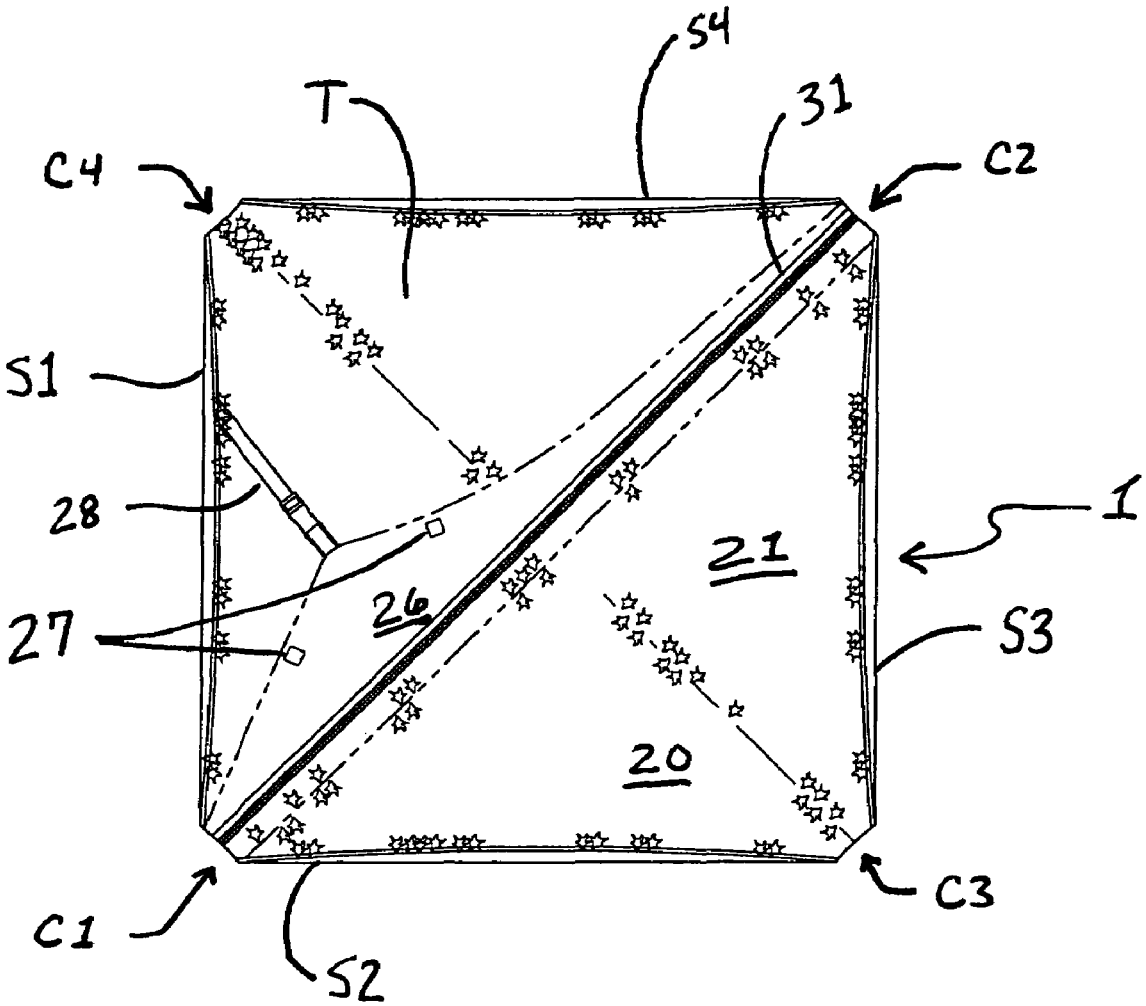
FIG. 4 is a top-down elevation of the enclosure of the present invention.
Figure 5:
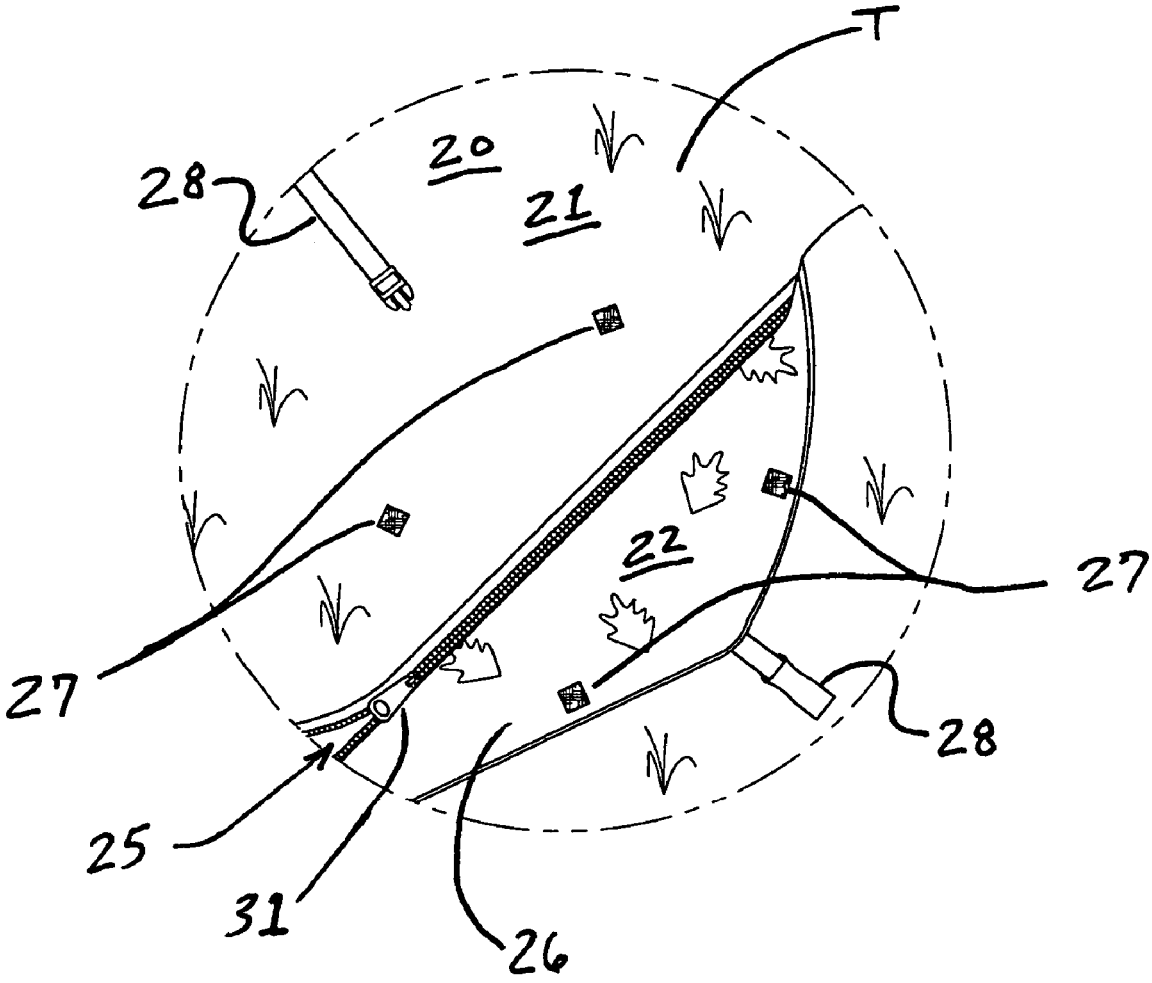
FIG. 5 is a detailed view of a portion of the slit defined in the flexible covering of the enclosure.

Referring now to FIGS. 4 and 5, the enclosure 1 may further be provided with means for partially covering the slit 25. More particularly, the inventive enclosure may be provided with a flap member 26 disposed on the top surface T of the flexible covering 20, the flap member 26 dimensioned to overlie and substantially cover the portion of zipper 31 extending across the top surface T. To secure the flap member 26 in place, fastening means may be provided on each of the flap member 26 and top surface T. As illustrated, these means may take the form of complementary hook-and-loop type fasteners 27. Additional means, such as the illustrated buckle-strap 28, may also be provided on each of the flap member 26 and top surface T.

Turning then to FIGS. 1 and 6–8, operation of the present invention will be better understood.

Figure 8:
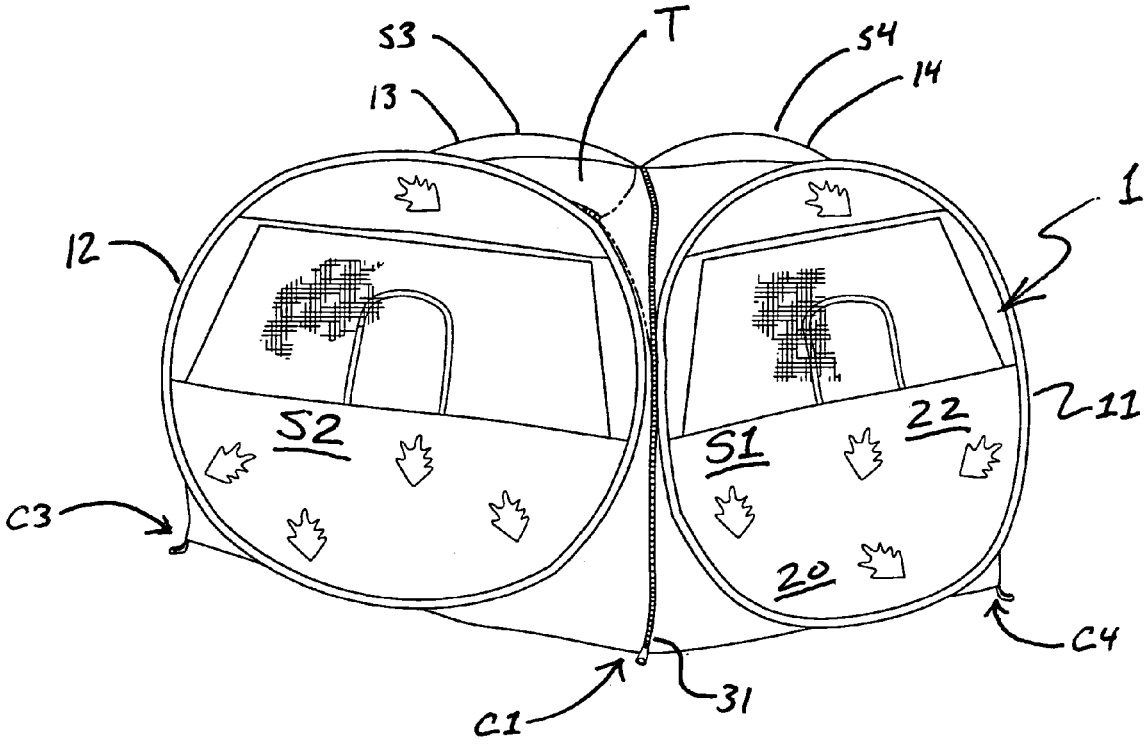

From the erected first condition of the enclosure 1 (FIG. 1), in which a first surface 21 of the flexible covering 20 is disposed on the exterior thereof, the at least one slit 25 is opened by operation of the zippers 30 and 31 which, in the illustrated embodiment, define the same. By this operation, the sidewalls S1 and S2, the top surface T and bottom surface B are all separated and, accordingly, the sidewalls S1–S4 may be hingedly moved relative to each other to reverse the original angle between adjacent sidewalls S1–S4 and thus turn the entire enclosure 1 inside-out (FIG. 8). Upon completion of this reversal, the at least one slit 25 is closed by operation of the zippers 30 and 31, thereby reconstituting the enclosure 1 in the second condition thereof, that is, the enclosure's fully assembled, though completely reversed state, thus presenting on the exterior thereof the second surface 22 of the flexible covering 20.

Of course, the foregoing enclosure is exemplary of the invention only and is not intended to be limiting thereof: other modifications, alterations, and variations thereof, within the level of ordinary skill in the art, are certainly possible, with the benefit of this disclosure, without departing from the spirit and broader aspects of the invention as set forth in the appended claims.

The invention in which an exclusive property or privilege is claimed is defined as follows:

1. A portable enclosure, comprising:

a collapsible framework having a flexible covering thereover to thereby define a plurality of sidewalls and a top surface of the enclosure, said flexible covering having opposite first and second surfaces each bearing a distinct color, pattern, or other indicia; and said plurality of sidewalls being hingedly movable relative to each other so as to facilitate the selective reversibility of said plurality of sidewalls and said top surface between a first condition, wherein said first surface of said flexible covering is disposed outside of said enclosure and said second surface of said flexible covering is disposed inside of said enclosure, and a second condition, wherein said second surface of said flexible covering is disposed outside of said enclosure and said first surface of said flexible covering is disposed inside of said enclosure; and wherein said enclosure is selectively reversible between said first and second conditions thereof without disassociating the flexible covering from the collapsible framework, and wherein further said portable enclosure is erected in both said first and second conditions thereof.

2. The portable enclosure of claim 1, wherein said flexible covering has at least one selectively closeable slit defined therein.

3. The portable enclosure of claim 2, wherein said at least one slit is defined by a zipper.

4. The portable enclosure of claim 2, wherein said collapsible framework comprises a plurality of separate frame elements, each said frame element defining one of said plurality of sidewalls of said enclosure.

5. The portable enclosure of claim 2, wherein said at least one slit is defined in said top surface of said enclosure, and between a first pair of said frame elements.

6. The portable enclosure of claim 2, wherein said flexible covering further defines a bottom of said enclosure.

7. The portable enclosure of claim 6, wherein said at least one slit is defined in said top and bottom surfaces of said enclosure, and between a first pair of said frame elements.

8. The portable enclosure of claim 1, wherein said flexible covering further defines a bottom of said enclosure.

9. A portable enclosure, comprising:

A collapsible frame having a flexible covering thereover to thereby define a plurality of sidewalls and a top surface of the enclosure; and Said flexible covering having opposite first and second surfaces, each bearing a different color, pattern, or other indicia, and further including at least one seam therein extending between a first pair of said plurality of sidewalls and along said top surface of said enclosure to thereby define at least first and second portions of said enclosure; and Said at least first and second enclosure portions being moveable relative to each other between a first condition, wherein said first surface of said flexible covering is substantially visible only from the exterior of the enclosure and said second surface is substantially visible only from the interior of said enclosure, and a second condition, wherein said second surface of said flexible covering is substantially visible only from the exterior of the enclosure and said first surface is substantially visible only from the interior of said enclosure;

Wherein said portable enclosure is selectively reversible in its entirety by moving said at least first and second enclosure portions between said first and second conditions; and Wherein further said portable enclosure is erected in both said first and second conditions.

10. The portable enclosure of claim 9, further comprising means for selectively closing said at least one seam.

11. The portable enclosure of claim 9, wherein said at least one seam is defined by a zipper.

12. The portable enclosure of claim 9, wherein said collapsible frame comprises a plurality of separate frame elements, each said frame element defining one of said plurality of sidewalls of said enclosure.

13. The portable enclosure of claim 12, wherein said at least one seam is defined in the top surface of the enclosure, and between a first pair of said frame elements.

14. The portable enclosure of claim 12, wherein said flexible covering further defines a bottom of the enclosure.

15. The portable enclosure of claim 14, wherein said at least one seam is defined in the top and bottom surfaces of said enclosure, and between a first pair of said frame elements.

16. The portable enclosure of claim 9, wherein the flexible covering further defines a bottom of said enclosure.

17. A portable enclosure, comprising:

A collapsible framework having a flexible covering associated therewith, said flexible covering having opposite first and second surfaces each bearing a different color, pattern, or other indicia;

Said enclosure being selectively reversible in its entirety between a first condition, wherein said first surface of said flexible covering is disposed substantially entirely outside of said enclosure and said second surface of said flexible covering is disposed substantially entirely inside of said enclosure, and a second condition, wherein said first surface of said flexible covering is disposed substantially entirely inside of said enclosure and said second surface of said flexible covering is disposed substantially entirely outside of said enclosure; and Wherein said enclosure is selectively reversible between said first and second conditions thereof without disassociating the flexible covering from the collapsible framework, and wherein further said portable enclosure is erected in both said first and second conditions thereof.

18. The portable enclosure of claim 17, wherein the collapsible framework and flexible covering define a plurality of sidewalls and a top surface of the enclosure, and said flexible covering has at least one slit defined therein, said at least one slit positioned so as to facilitate selective arrangement of said plurality of sidewalls and said top surface between said first and second conditions of said enclosure.

19. The portable enclosure of claim 18, further comprising means for selectively closing said at least one slit.

20. The portable enclosure of claim 18, wherein said at least one slit is defined by a zipper.

21. The portable enclosure of claim 18, wherein said collapsible framework comprises a plurality of separate frame elements, each said frame element defining one of said plurality of sidewalls of said enclosure.

22. The portable enclosure of claim 21, wherein said at least one slit is defined in said top surface of said enclosure, and between a first pair of said frame elements.

23. The portable enclosure of claim 18, wherein said flexible covering further defines a bottom of said enclosure.

24. The portable enclosure of claim 23, wherein said at least one slit is defined in said top and bottom surfaces of said enclosure, and between a first pair of said plurality of sidewalls.

* * * * *

UNITED STATES PATENT AND TRADEMARK OFFICE

CERTIFICATE OF CORRECTION

PATENT NO. : 7,178,538 B2
APPLICATION NO. : 11/358667
DATED : February 20, 2007
INVENTOR(S) : Robert M. Ransom It is certified that error appears in the above-identified patent and that said Letters Patent is hereby corrected as shown below:

In Col. 1, line 62, please delete “patters” and insert -- patterns --.

In Col. 2, lines 20-21, please delete “The specification discloses a portable enclosure comprising”.

In Col. 4, line 42, please delete “fabric” and insert -- flexible --.

In Col. 6, line 18, please delete the ward “and”.

In Col. 6, line 58, please delete the word “and”.

In Col. 6, line 65, please delete the word “and”.

Signed and Sealed this

Tenth Day of April, 2007

JON W. DUDAS
*Director of the United States Patent and Trademark Office*